US009635476B2

(12) United States Patent
Han et al.

(10) Patent No.: US 9,635,476 B2
(45) Date of Patent: Apr. 25, 2017

(54) METHOD OF PREVENTING FEEDBACK BASED ON DETECTION OF POSTURE AND DEVICES FOR PERFORMING THE METHOD

(71) Applicant: Samsung Electronics Co., Ltd., Suwon-si (KR)

(72) Inventors: Jonghee Han, Seoul (KR); Jongjin Kim, Hwaseong-si (KR); Hee Suk Shin, Daejeon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/474,807

(22) Filed: Sep. 2, 2014

(65) Prior Publication Data

US 2015/0063613 A1 Mar. 5, 2015

(30) Foreign Application Priority Data

Sep. 4, 2013 (KR) ..... 10-2013-0106285

(51) Int. Cl.
*H04R 25/00* (2006.01)

(52) U.S. Cl.
CPC ..... *H04R 25/554* (2013.01); *H04R 25/453* (2013.01); *H04R 2225/61* (2013.01); *H04R 2460/03* (2013.01)

(58) Field of Classification Search
CPC ..... H04R 25/45; H04R 25/453; H04R 25/55; H04R 25/552; H04R 2225/61; H04R 2460/03; H04R 2460/07; H04R 25/43; H04R 2225/53
See application file for complete search history.

(56) References Cited

U.S. PATENT DOCUMENTS

| | | | | |
|---|---|---|---|---|
| 4,955,729 | A * | 9/1990 | Marx | H04R 25/453 381/123 |
| 6,330,339 | B1 * | 12/2001 | Ishige | H04R 25/502 381/312 |
| 7,853,030 | B2 * | 12/2010 | Grasbon | H04R 25/558 381/314 |
| 7,953,237 | B2 * | 5/2011 | Sporer | H04R 25/453 381/312 |
| 8,121,321 | B2 * | 2/2012 | Iwano | H04R 25/43 381/312 |
| 8,971,554 | B2 * | 3/2015 | van Halteren | H04R 25/30 381/312 |
| 9,271,103 | B2 * | 2/2016 | Wells | H04S 7/304 |
| 2005/0094834 | A1 | 5/2005 | Chalupper | |
| 2015/0003652 | A1 * | 1/2015 | Bisgaard | H04R 25/50 381/314 |

(Continued)

*Primary Examiner* — Curtis Kuntz
*Assistant Examiner* — Ryan Robinson
(74) *Attorney, Agent, or Firm* — NSIP Law

(57) ABSTRACT

A hearing apparatus includes a first hearing device and a second hearing device. The first hearing device is configured to block a transmission path of a first digital signal, based on a posture of a user wearing the first hearing device and the second hearing device, the first digital signal being based on a first audio signal. The second hearing device is configured to wirelessly transmit a second digital signal to the first hearing device, based on the posture of the user, the second digital signal being based on a second audio signal.

19 Claims, 8 Drawing Sheets

(56) References Cited

U.S. PATENT DOCUMENTS

| | | | | |
|---|---|---|---|---|
| 2015/0181355 | A1* | 6/2015 | Pedersen | H04R 25/407<br>381/313 |
| 2015/0230036 | A1* | 8/2015 | Pedersen | H04R 1/1041<br>381/330 |

* cited by examiner

METHOD OF PREVENTING FEEDBACK BASED ON DETECTION OF POSTURE AND DEVICES FOR PERFORMING THE METHOD

CROSS-REFERENCE TO RELATED APPLICATION

This application claims the benefit under 35 USC 119(a) of Korean Patent Application No. 10-2013-0106285, filed on Sep. 4, 2013, in the Korean Intellectual Property Office, the entire disclosure of which is incorporated herein by reference for all purposes.

BACKGROUND

1. Field

The following description relates to a method of preventing feedback based on detection of a posture, and devices for performing the method.

2. Description of Related Art

A hearing device provides a user with an audio signal. The hearing device may include, for example, a hearing aid, a sound device, and the like.

A hearing aid may amplify a sound coming from surroundings of a user wearing the hearing aid, to help the user to clearly listen to the sound. Typically, the hearing aid may include, for example, a pocket type hearing aid, an earring type hearing aid, a concha type hearing aid, an eardrum hearing aid, and the like.

A user may use a sound device to listen to music or voice through a radio, a stereo, and the like. The sound device may include a device fixed or attached to an ear of a user, for example, an earphone, a headphone, and the like.

As technology is developed, functions provided by a hearing device are increasingly diversified. The hearing device may remove a feedback through an adaptive filtering scheme in signal processing.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided a hearing apparatus including a first hearing device and a second hearing device. The first hearing device is configured to block a transmission path of a first digital signal, based on a posture of a user wearing the first hearing device and the second hearing device, the first digital signal being based on a first audio signal. The second hearing device is configured to wirelessly transmit a second digital signal to the first hearing device, based on the posture of the user, the second digital signal being based on a second audio signal.

The first hearing device and the second hearing device may be further configured to operate in a low-power operation mode based on a strength of the first digital signal and a strength of the second digital signal, and turn off a wireless communication in the low-power operation mode.

The first hearing device and the second hearing device may be further configured to sense a movement of the user, and detect the posture of the user based on the sensed movement.

The first hearing device and the second hearing device may be configured to periodically sense the movement of the user.

The first hearing device may include a microphone configured to sense a sound, and generate the first audio signal based on the sensed sound, an analog-to-digital converter configured to convert the first audio signal to the first digital signal, an acceleration sensor configured to sense a movement of the user, and generate a sensing signal based on the sensed movement, and a digital signal processor (DSP) configured to measure an acceleration of gravity of the first hearing device based on the sensing signal, detect the posture of the user based on the measured acceleration of gravity, and block the transmission path of the first digital signal based on the detected posture.

The DSP may be configured to block the transmission path of the first digital signal in response to the measured acceleration of gravity being greater than or equal to a set threshold.

The second hearing device may include a microphone configured to sense a sound, and generate the second audio signal based on the sensed sound, an analog-to-digital converter configured to convert the second audio signal to the second digital signal, an acceleration sensor configured to sense a movement of the user, and generate a sensing signal based on the sensed movement, and a digital signal processor (DSP) configured to measure an acceleration of gravity of the second hearing device based on the sensing signal, detect the posture of the user based on the measured acceleration of gravity, and transmit the second digital signal to the first hearing device based on the detected posture.

The DSP may be configured to transmit the second digital signal to the first hearing device in response to the measured acceleration of gravity being less than or equal to a set threshold.

In another aspect, there is provided a hearing device including a microphone configured to sense a sound, and generate an audio signal based on the sensed sound, an analog-to-digital converter configured to convert the audio signal to a digital signal, an acceleration sensor configured to sense a movement of a user wearing the hearing device, and generate a sensing signal based on the sensed movement, and a digital signal processor (DSP) configured to detect a posture of the user based on the sensing signal, and block a transmission path of the digital signal, or transmit the digital signal to another hearing device, based on the detected posture.

The DSP may be further configured to control the hearing device to operate in a low-power operation mode based on a strength of the digital signal. The operation in the low-power operation mode may include turning off the transmission of the digital signal to the other hearing device.

The acceleration sensor may be configured to periodically sense the movement of the user, and the DSP may be configured to measure an acceleration of gravity based on the sensing signal, sample values of the measured acceleration of gravity for a predetermined period of time, and block the transmission path of the digital signal, or transmit the digital signal to the other hearing device, based on the sampled values of the measured acceleration of gravity.

The DSP may be configured to block the transmission path of the digital signal in response to a value of the measured acceleration of gravity being greater than or equal to a set threshold.

The DSP may be configured to transmit the digital signal to the other hearing device in response to a value of the measured acceleration of gravity being less than or equal to a set threshold.

The hearing device may further include a communication unit configured to wirelessly transmit the digital signal to the other hearing device.

In still another general aspect, there is provided an operation method of a hearing device, including sensing a movement of a user wearing the hearing device, generating a sensing signal based on the sensed movement, detecting a posture of the user based on the sensing signal, and blocking a transmission path of a digital signal, based on the detected posture, the digital signal being based on an audio signal.

The operation method may further include transmitting the digital signal to another hearing device, based on the detected posture.

The operation method may further include operating in a low-power operation mode based on a strength of the digital signal. The operating in the low-power operation mode may include turning off the transmitting of the digital signal to the other hearing device.

A non-transitory computer-readable storage medium may store a program comprising instructions to cause a computer to perform the operation method.

In yet another general aspect, there is provided a hearing device including a processor configured to detect a posture of a user wearing the hearing device based on a movement of the user, block a transmission path of a digital signal, based on the detected posture, the digital signal being based on an audio signal, and transmit the digital signal to another hearing device, based on the detected posture.

The processor may configured to block the transmission path of the digital signal in response to the detected posture being a posture in which an ear of the user that wears the hearing device is directed towards the center of the earth; and transmit the digital signal to the other hearing device in response to the detected posture being a posture in which the ear of the user is directed opposite to the center of the earth.

Other features and aspects will be apparent from the following detailed description, the drawings, and the claims.

Figure 1:
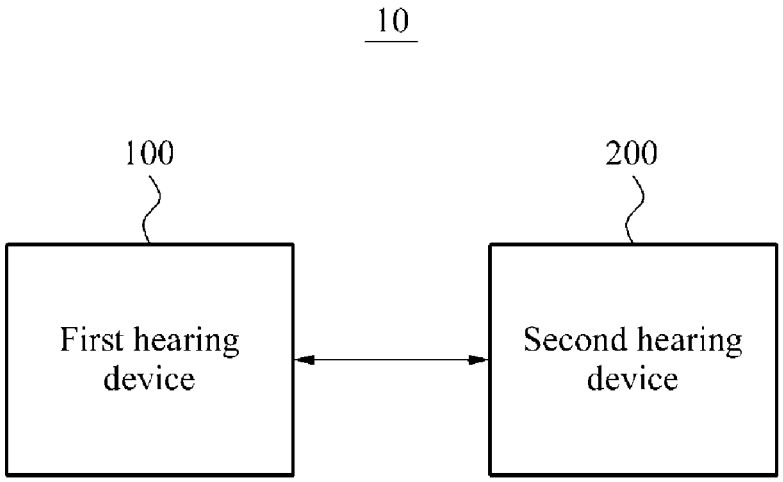
FIG. 1 is a block diagram illustrating an example of a hearing apparatus including hearing devices.

Throughout the drawings and the detailed description, unless otherwise described, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

FIG. 1 illustrates an example of a hearing apparatus 10 including hearing devices. Referring to FIG. 1, the hearing apparatus 10 includes a first hearing device 100 and a second hearing device 200.

The term "hearing device" used herein refers to any device that is detachably fixed or attached to an ear of a user and that is configured to provide the user with an audio signal based on a sound coming from an external source. The hearing device may include, for example, a hearing aid configured to amplify the audio signal and to help the user to recognize the amplified audio signal. In addition, the hearing device may include, for example, a system to support a hearing aid function, a plug-in accessory, a hearing aid module, and/or a chip with a hearing aid function. The system may include, for example, a mobile device, a television (TV), a clinical engineering-information technology (CE-IT) device, and/or other devices known to one of ordinary skill in the art. The plug-in accessory or the hearing aid module may have a function of relaying sounds or broadcasts. The hearing device may include a monaural device enabling an audio signal to be generated from a single ear, and a binaural device enabling audio signals to be generated from both ears.

Each of the first hearing device 100 and the second hearing device 200 senses a sound coming from an external source, generates or detects an audio signal, and converts the audio signal to a digital signal. Each of the first hearing device 100 and the second hearing device 200 generates a signal corresponding to the sound, based on the digital signal, and provides the generated signal to a user wearing the first hearing device 100 and the second hearing device 200.

For example, the first hearing device 100 may sense a sound coming from an external source, may generate or detect a first audio signal, and may convert the first audio signal to a first digital signal. The first hearing device 100 may generate a signal corresponding the sound, based on the first digital signal, and may transmit the generated signal to an ear of the user wearing the first hearing device 100.

The second hearing device 200 may sense a sound coming from an external source, may generate or detect a second audio signal, and may convert the second audio signal to a second digital signal. The second hearing device 200 may generate a signal corresponding to the sound, based on the second digital signal, and may transmit the generated signal to an ear of the user wearing the second hearing device 200. In this example, the user may recognize the sound through the first hearing device 100 and the second hearing device 200.

The first hearing device 100 blocks a transmission path of the first digital signal, based on a posture of the user. By blocking the transmission path of the first digital signal, the first hearing device 100 may prevent a feedback phenomenon or a howling phenomenon that occurs in the first hearing device 100 based on the posture of the user.

The second hearing device 200 transmits the second digital signal to the first hearing device 100, based on the posture of the user. For example, using a wireless communication scheme, the second hearing device 200 may transmit the second digital signal to the first hearing device 100. In this example, the first hearing device 100 may generate a signal corresponding to the sound coming from the external source, using the second digital signal received from the second hearing device 200 by the wireless communication scheme, and may transmit the generated signal to the ear wearing the first hearing device 100. The user may recognize the sound through the ear wearing the first hearing device 100.

In an example, each of the first hearing device 100 and the second hearing device 200 may sense the movement of the user, and may detect a posture of the user based on the sensed movement. For example, each of the first hearing device 100 and the second hearing device 200 may periodically sense the movement of the user.

In this example, the first hearing device 100 may sense the movement of the user, may detect the posture of the user, based on the sensed movement, and may block the transmission path of the first digital signal based on the detected posture. Additionally, the second hearing device 200 may sense the movement of the user, may detect the posture of the user, based on the sensed movement, and may transmit the second digital signal to the first hearing device 100 based on the detected posture.

In another example, each of the first hearing device 100 and the second hearing device 200 may operate in a normal operation mode or a low-power operation mode. The normal operation mode refers to an operation mode to perform a typical operation of the first hearing device 100 or the second hearing device 200, for example, an operation of a typical hearing aid or an operation of a typical sound device. The low-power operation mode refers to an operation mode to control an operation of each of at least one predetermined element among elements of the first hearing device 100 or the second hearing device 200 to reduce power consumed in the first hearing device 100 or the second hearing device 200.

Each of the first hearing device 100 and the second hearing device 200 may operate in the low-power operation mode, based on a strength of a digital signal. For example, the first hearing device 100 may operate in the low-power operation mode, based on a strength of the first digital signal, and the second hearing device 200 may operate in the low-power operation mode, based on a strength of the second digital signal.

In the low-power operation mode, each of the first hearing device 100 and the second hearing device 200 may turn off a wireless communication. For example, in the low-power operation mode, the second hearing device 200 may not transmit the second digital signal to the first hearing device 100 through the wireless communication. By turning off the wireless communication, the first hearing device 100 and the second hearing device 200 may reduce unnecessary power.

For convenience of description, an operation of the first hearing device 100 and an operation of the second hearing device 200 are separately described. However, the first hearing device 100 may perform the operation of the second hearing device 200, and the second hearing device 200 may perform the operation of the first hearing device 100.

For example, the first hearing device 100 may transmit the first digital signal to the second hearing device 200, based on the detected posture. In this example, the second hearing device 200 may block a transmission path of the second digital signal, based on the detected posture.

Figure 2:
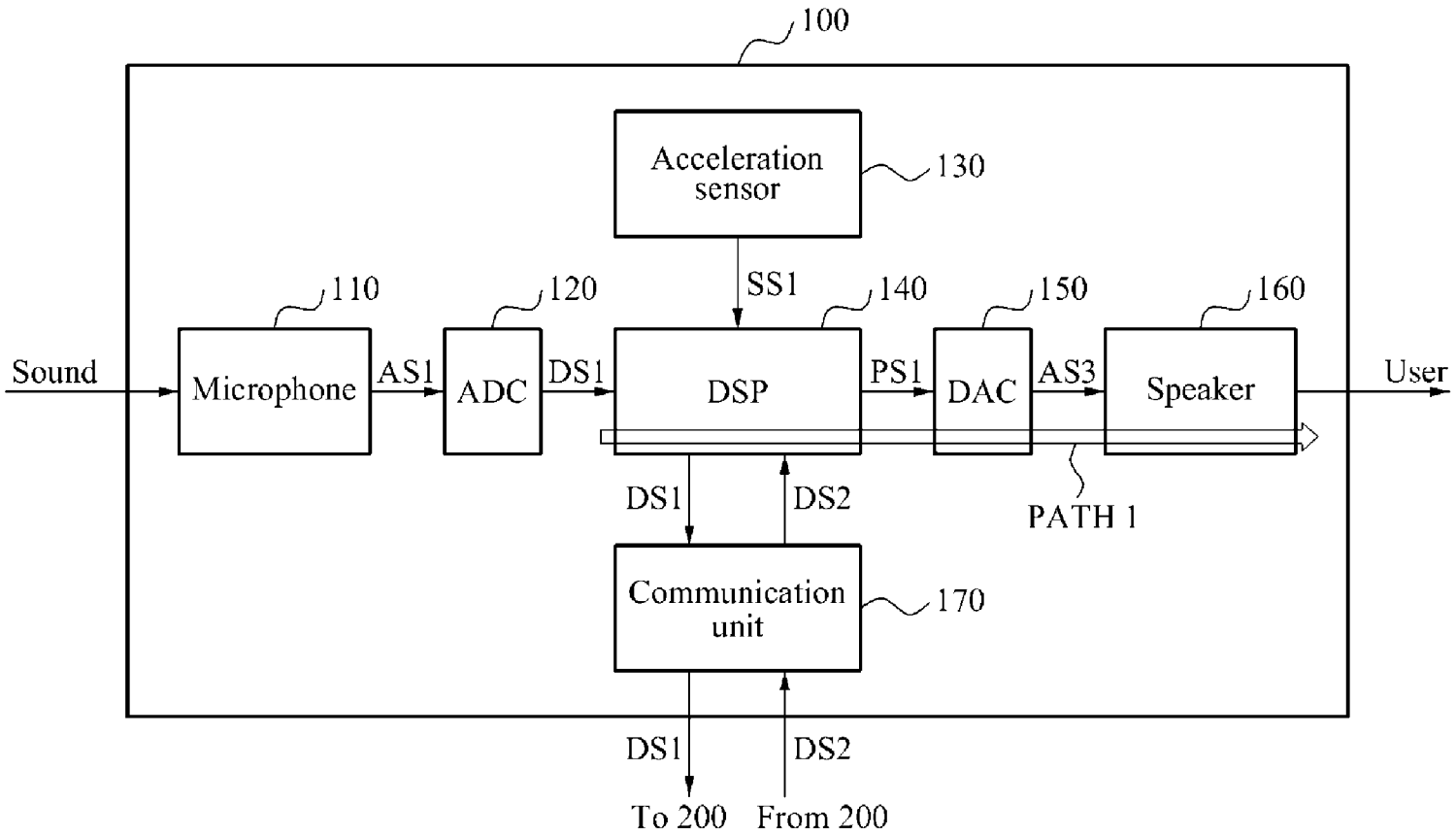
FIG. 2 is a block diagram illustrating an example of a first hearing device of FIG. 1.

FIG. 2 illustrates an example of the first hearing device 100 of FIG. 1. Referring to FIGS. 1 and 2, the first hearing device 100 includes a microphone 110, an analog-to-digital converter (ADC) 120, an acceleration sensor 130, a digital signal processor (DSP) 140, a digital-to-analog converter (DAC) 150, a speaker 160, and a communication unit 170.

The microphone 110 senses a sound coming from an external source, and generates a first audio signal AS1 based on the sensed sound. The microphone 110 transmits the first audio signal AS1 to the ADC 120.

The ADC 120 converts the first audio signal AS1 to a first digital signal DS1. The first audio signal AS1 may be, for example, an analog signal. The ADC 120 transmits the first digital signal DS1 to the DSP 140.

The acceleration sensor 130 senses a movement of a user, and generates a first sensing signal SS1 based on the sensed movement. The acceleration sensor 130 transmits the first sensing signal SS1 to the DSP 140. In an example, the acceleration sensor 130 may periodically sense the movement of the user, may generate the first sensing signal SS1 based on the sensed movement, and may periodically transmit the first sensing signal SS1 to the DSP 140.

The DSP 140 controls an overall operation of the first hearing device 100. For example, the DSP 140 may control an operation of each of the microphone 110, the ADC 120, the acceleration sensor 130, the DAC 150, the speaker 160, and the communication unit 170.

The DSP 140 receives the first digital signal DS1 from the ADC 120. Additionally, the DSP 140 receives a second digital signal DS2 through the communication unit 170 from the second hearing device 200.

The DSP 140 processes the first digital signal DS1 or the second digital signal DS2 to generate a processed signal PS1, and transmits the processed signal PS1 to the DAC 150. For example, the DSP 140 may remove a feedback phenomenon and/or noise included in the first digital signal DS1 or the second digital signal DS2. The DSP 140 may remove the feedback phenomenon, using an adaptive filtering scheme. Additionally, the DSP 140 may amplify the first digital signal DS1 or the second digital signal DS2.

The DSP 140 detects a posture of the user, based on the first sensing signal SS1. Based on the detected posture, the DSP 140 may block a transmission path PATH1 of the first digital signal DS1, and/or may transmit the first digital signal DS1 through the communication unit 170 to the second hearing device 200.

In an example, the DSP 140 may measure or extract an acceleration of gravity of the first hearing device 100 from the first sensing signal SS1, and may detect the posture of the user based on the measured acceleration of gravity. The measured acceleration of gravity may include, for example, a value of an acceleration of gravity in a predetermined direction, for example, an x-axial direction, a y-axial direction, or a z-axial direction.

In another example, the DSP 140 may perform sampling of the first sensing signal SS1 that is periodically received from the acceleration sensor 130, for a predetermined period of time, and may detect a posture of the user that is maintained during the predetermined period of time based on a result of the sampling. For example, the DSP 140 may measure an acceleration of gravity from the periodically received first sensing signal SS1, may perform sampling of values of the measured acceleration of gravity for a predetermined period of time, may determine the acceleration of gravity based on a result of the sampling, and may detect a posture of the user based on the determined acceleration of gravity.

The DSP 140 may control the first hearing device 100 to operate in the low-power operation mode, based on a strength of the first digital signal DS1. For example, the DSP 140 may control the communication unit 170 to be powered off in the low-power operation mode.

The DAC 150 converts the processed signal PS1 output from the DSP 140 to an analog signal, for example, a third audio signal AS3. The processed signal PS1 may be, for example, a digital signal. The DAC 150 transmits the third audio signal AS3 to the speaker 160.

The speaker 160 receives the third audio signal AS3 from the DAC 150, and transmits the third audio signal AS3 to the ear of the user wearing the first hearing device 100. The speaker 160 may be, for example, a receiver.

The first hearing device 100 and the second hearing device 200 communicate with each other through the communication unit 170. For example, the first hearing device 100 and the second hearing device 200 may exchange signals or data with each other through the communication unit 170.

The communication unit 170 transfers the first digital signal DS1 from the DSP 140 to the second hearing device 200. Additionally, the communication unit 170 transfers the second digital signal DS2 from the second hearing device 200 to the DSP 140. The communication unit 170 may be powered off in the low-power operation mode, based on a control of the DSP 140.

In FIG. 2, the first digital signal DS1 transmitted from the DSP 140 to the communication unit 170 may be identical to the first digital signal DS1 transmitted from the communication unit 170 to the second hearing device 200. However, the communication unit 170 may process the first digital signal DS1, and may transmit the processed first digital signal DS1 to the second hearing device 200. In other words, the first digital signal DS1 may differ from the processed first digital signal DS1. Similarly, the second digital signal DS2 transmitted from the second hearing device 200 to the communication unit 170 may differ from the second digital signal DS2 transmitted from the communication unit 170 to the DSP 140.

Figure 3:
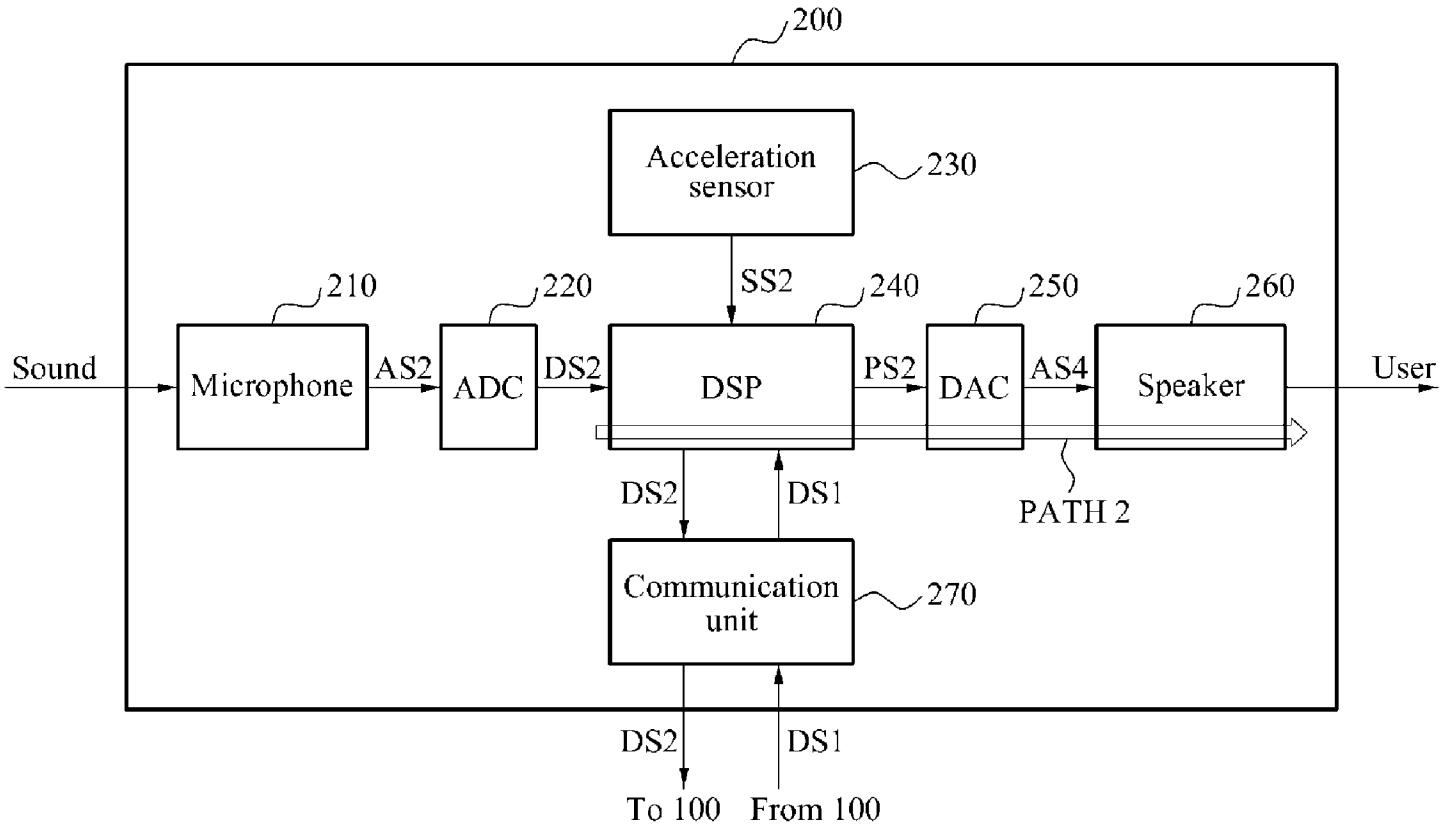
FIG. 3 is a block diagram illustrating an example of a second hearing device of FIG. 1.

FIG. 3 illustrates an example of the second hearing device 200 of FIG. 1. Referring to FIGS. 1 and 3, the second hearing device 200 includes a microphone 210, an ADC 220, an acceleration sensor 230, a DSP 240, a DAC 250, a speaker 260, and a communication unit 270.

A structure and an operation of the second hearing device 200 of FIG. 3 may be substantially the same as a structure and an operation of the first hearing device 100 of FIG. 2. An operation of each of the microphone 210, the ADC 220, the acceleration sensor 230, the DSP 240, the DAC 250, the speaker 260, and the communication unit 270 in the second hearing device 200 may be substantially the same as an operation of each of the microphone 110, the ADC 120, the acceleration sensor 130, the DSP 140, the DAC 150, the speaker 160, and the communication unit 170, respectively, in the first hearing device 100. Accordingly, further description of the microphone 210, the ADC 220, the acceleration sensor 230, the DSP 240, the DAC 250, the speaker 260, and the communication unit 270 in the second hearing device 200 is omitted herein for conciseness.

Figure 4:
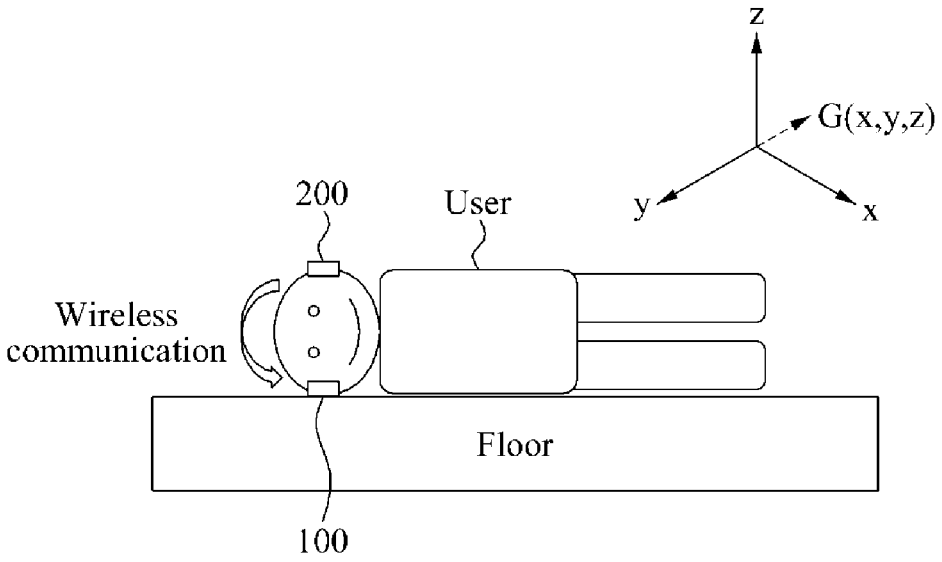
FIGS. 4 and 5 are diagrams illustrating an example of a method of detecting a posture of a user, using the hearing apparatus of FIG. 1.
Figure 5:
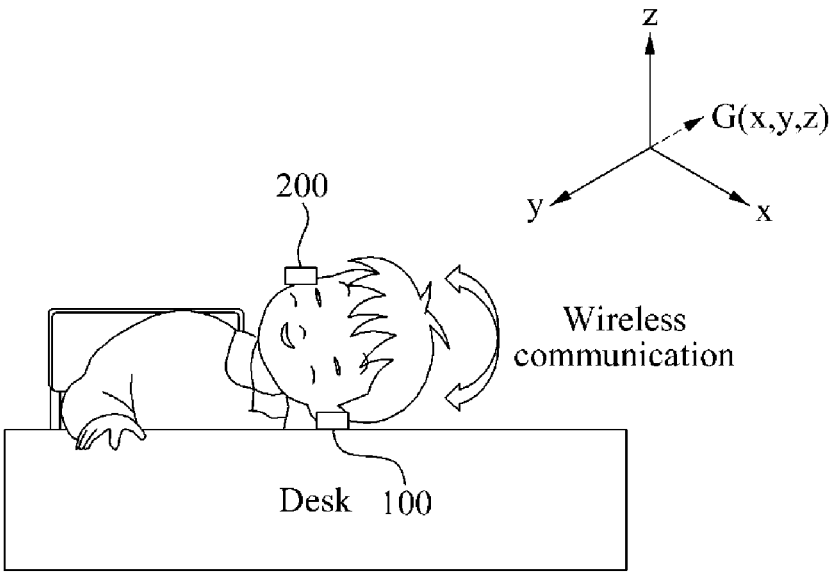

FIGS. 4 and 5 illustrate an example of a method of detecting a posture of a user using the hearing apparatus 10 of FIG. 1. FIG. 4 illustrates an example in which a user using the hearing apparatus 10 lies down on a floor, for example, a bed, and FIG. 5 illustrates an example in which another user using the hearing apparatus 10 puts his or her head down on a desk. For convenience of description, FIGS. 4 and 5 illustrate a posture of lying down on the floor, and a posture of putting his or her head down on the desk; however, the description herein is not limited to a predetermined posture of a user.

Referring to FIGS. 1 through 5, the first hearing device 100 blocks the transmission path PATH1 of the first digital signal DS1, based on the posture of the user. In detail, the microphone 110 senses the sound coming from the external source, generates the first audio signal AS1, and transmits the first audio signal AS1 to the ADC 120.

The ADC 120 converts the first audio signal AS 1 to the first digital signal DS1, and transmits the first digital signal DS1 to the DSP 140. The acceleration sensor 130 senses the movement of the user, generates the first sensing signal SS1, and transmits the first sensing signal SS1 to the DSP 140. For example, the acceleration sensor 130 may periodically sense the movement of the user, may generate the first sensing signal SS1, and may periodically transmit the first sensing signal SS1 to the DSP 140.

The DSP 140 detects the posture of the user, based on the first sensing signal SS1, and blocks the transmission path PATH1 of the first digital signal DS1 based on the detected posture. In an example, the DSP 140 may measure or extract an acceleration of gravity G of the first hearing device 100 from the first sensing signal SS1, and may detect the posture of the user based on the measured acceleration of gravity G. The measured acceleration of gravity G may include, for example, a value of an acceleration of gravity in a predetermined direction, for example, an x-axial direction, a y-axial direction, or a z-axial direction.

For example, the DSP 140 may determine that the acceleration of gravity G points towards the center of the earth, for example, in a negative z-axial direction, and has a positive value, and may detect the posture of lying down or putting his or her head down. The DSP 140 may determine that an ear of the user wearing the first hearing device 100 is directed towards the center of the earth.

In another example, the DSP 140 may perform sampling of the first sensing signal SS1 that is periodically received from the acceleration sensor 130, for a predetermined period of time, and may detect the posture of the user that is maintained during the predetermined period of time based on a result of the sampling. For example, the DSP 140 may measure the acceleration of gravity G from the periodically received first sensing signal SS1, may perform sampling of values of the measured acceleration of gravity G for the predetermined period of time, may determine the acceleration of gravity G based on a result of the sampling, and may detect the posture of the user based on the determined acceleration of gravity G. An operation of detecting the posture of the user based on the determined acceleration of gravity G has been described above, and accordingly, further description thereof is omitted herein for conciseness.

By blocking the transmission path PATH1, the DSP 140 may prevent a feedback phenomenon caused by adhering the first hearing device 100 to an obstacle, for example, a pillow, a floor, and an arm, because the user lies down.

Referring again to FIGS. 1 through 5, the second hearing device 200 transmits a second digital signal DS2 based on a second audio signal AS2 generated from an external source, to the first hearing device 100, based on the posture of the user. In detail, the microphone 210 senses the sound coming from the external source, generates the second audio signal AS2, and transmits the second audio signal AS2 to the ADC 220.

The ADC 220 converts the second audio signal AS2 to the second digital signal DS2, and transmits the second digital signal DS2 to the DSP 240. The acceleration sensor 230 senses the movement of the user, generates a second sensing signal SS2, and transmits the second sensing signal SS2 to the DSP 240. For example, the acceleration sensor 230 may periodically sense the movement of the user, may generate the second sensing signal SS2, and may periodically transmit the second sensing signal SS2 to the DSP 240.

The DSP 240 detects the posture of the user, based on the second sensing signal SS2, and transmits the second digital signal DS2 to the first hearing device 100 based on the detected posture. In an example, the DSP 240 may measure or extract an acceleration of gravity G of the second hearing device 200 from the second sensing signal SS2, and may detect the posture of the user based on the measured acceleration of gravity G. The measured acceleration of gravity G may include, for example, a value of an acceleration of gravity in a predetermined direction, for example, an x-axial direction, a y-axial direction, or a z-axial direction.

For example, the DSP 240 may determine that the acceleration of gravity G points in a direction opposite to the center of the earth, for example, in a positive z-axial direction, and has a negative value, and may detect the posture of lying down or putting his or her head down. The DSP 240 may determine that an ear of the user wearing the second hearing device 200 is directed in the direction opposite to the center of the earth.

In another example, the DSP 240 may perform sampling of the second sensing signal SS2 that is periodically received from the acceleration sensor 230, for a predetermined period of time, and may detect the posture of the user that is maintained during the predetermined period of time based on a result of the sampling. For example, the DSP 240 may measure the acceleration of gravity G from the periodically received second sensing signal SS2, may perform sampling of values of the measured acceleration of gravity G for the predetermined period of time, may determine the acceleration of gravity G based on a result of the sampling, and may detect the posture of the user based on the determined acceleration of gravity. An operation of detecting the posture of the user based on the determined acceleration of gravity G has been described above, and accordingly, further description thereof is omitted herein for conciseness.

The DSP 240 transmits the second digital signal DS2 to the DSP 140 of the first hearing device 100 through the communication unit 270. Accordingly, the DSP 140 generates a signal corresponding to the sound, namely, the third audio signal AS3, based on the second digital signal DS2, while preventing the feedback phenomenon.

Accordingly, through the ear wearing the first hearing device 100, the user may recognize the sound. For example, when the user is sleeping, for example, lying on his side or putting his head down on his side, the user may recognize a sound of a bell and an emergency situation, for example, a fire alarm, through the ear wearing the first hearing device 100.

Figure 6:
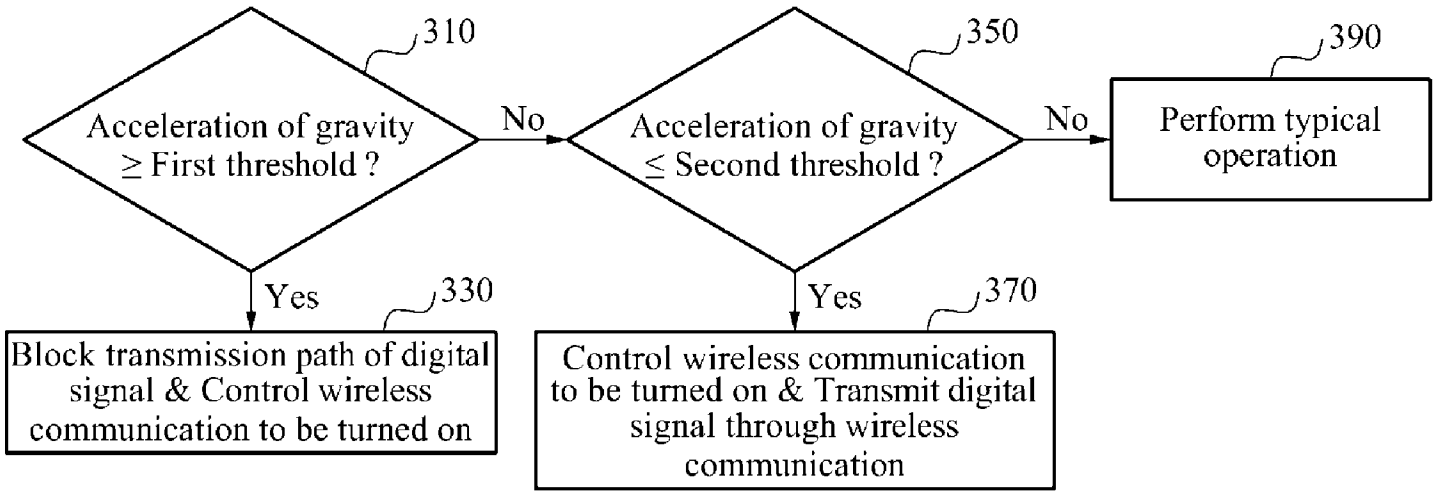
FIG. 6 is a flowchart illustrating an example of an operation method of a hearing device.

FIG. 6 illustrates an example of an operation method of a hearing device. Referring to FIGS. 1 through 6, the hearing device, for example, the first hearing device 100 or the second hearing device 200, senses a movement of a user, and measures an acceleration of gravity of the hearing device, for example, the acceleration of gravity G.

In operation 310, the hearing device compares a value of the measured acceleration of gravity with a first threshold. For example, the hearing device may determine whether the value of the measured acceleration of gravity is greater than or equal to the first threshold. The first threshold may be, for example, a value of an acceleration of gravity pointing towards the center of the earth, and may have a positive value. When the value of the measured acceleration of gravity is greater than or equal to the first threshold, the hearing device continues with operation 330. Otherwise, the hearing device continues with operation 350.

In operation 330, the hearing device blocks a transmission path of a digital signal, for example, the first digital signal DS1 or the second digital signal DS2, and controls a wireless communication to be turned on. The transmission path may be, for example, the transmission path PATH1 or PATH2.

In operation 350, the hearing device compares the value of the measured acceleration of gravity with a second threshold. For example, the hearing device may determine whether the value of the measured acceleration of gravity is less than or equal to the second threshold. The second threshold may be, for example, a value of an acceleration of gravity pointing in the direction opposite to the center of the earth, and may have a negative value. When the value of the measured acceleration of gravity is less than or equal to the second threshold, the hearing device continues with operation 370. Otherwise, the hearing device continues with operation 390.

In operation 370, the hearing device controls the wireless communication to be turned on, and transmits the digital signal to another hearing device through the wireless communication.

In operation 390, the hearing device performs a typical operation, for example, an operation of a typical hearing aid.

The first threshold and the second threshold may be set by a DSP, for example, the DSP 140 or 240.

Figure 7:
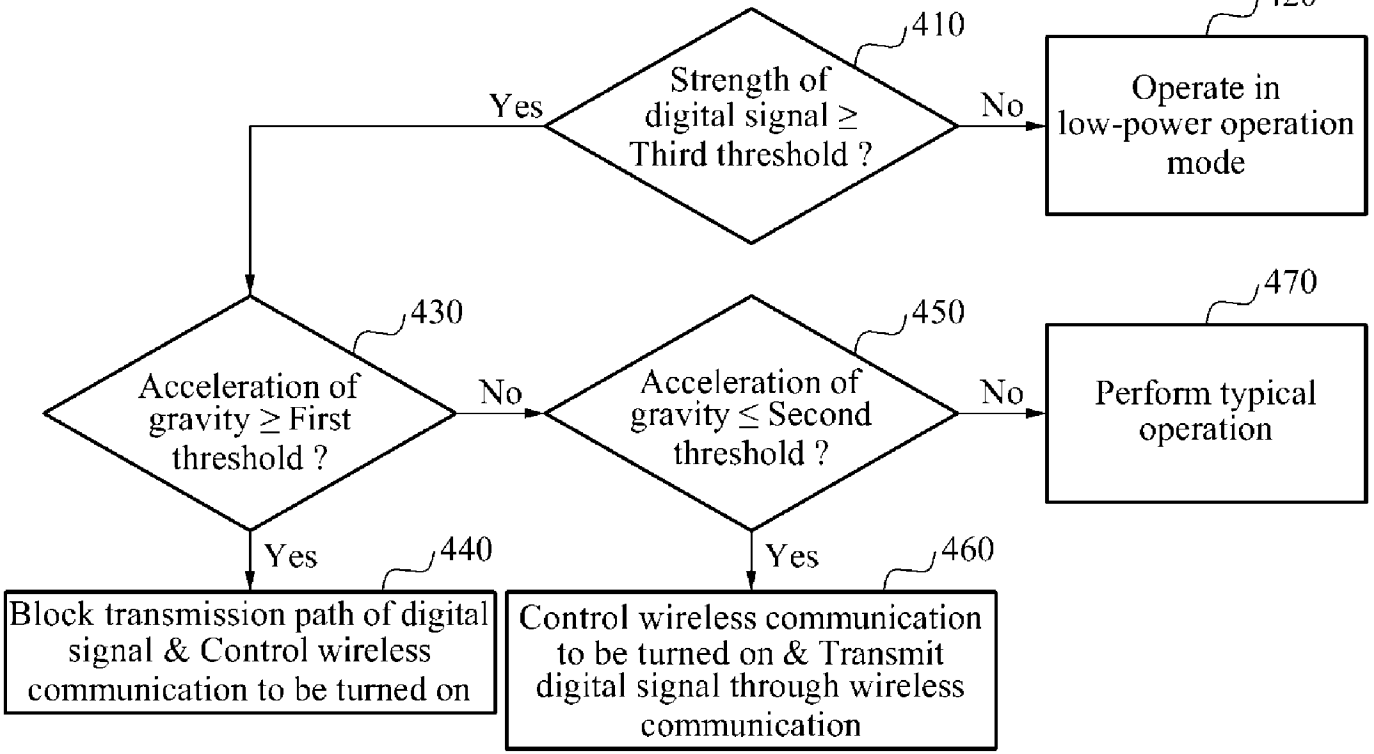
FIG. 7 is a flowchart illustrating another example of an operation method of a hearing device.

FIG. 7 illustrates another example of an operation method of a hearing device. Referring to FIGS. 1 through 5 and 7, the hearing device, for example, the first hearing device 100 or the second hearing device 200, senses a sound coming from an external source, and generates a digital signal, for example, the first digital signal DS1 or the second digital signal DS2. The hearing device controls an operation mode based on a strength of the digital signal.

In detail, in operation 410, the hearing device compares the strength of the digital signal with a third threshold. For example, the hearing device may determine whether the strength of the digital signal is greater than or equal to the third threshold. When the strength of the digital signal is greater than or equal to the third threshold, the hearing device continues with operation 430. Otherwise, the hearing device continues with operation 420.

In operation 420, the hearing device operates in a low-power operation mode. For example, the hearing device may control a wireless communication to be turned off.

In operation 430, the hearing device operates in a normal operation mode, for example, may perform operations 430, 440, 450, 460, and/or 470. The hearing device senses a movement of a user wearing the hearing device, and measures an acceleration of gravity of the hearing device, for example, an acceleration of gravity G. The hearing device compares a value of the measured acceleration of gravity with a first threshold. For example, the hearing device may determine whether the value of the measured acceleration of gravity is greater than or equal to the first threshold. The first threshold may be, for example, a value of an acceleration of gravity pointing towards the center of the earth, and may have a positive value. When the value of the measured acceleration of gravity is greater than or equal to the first threshold, the hearing device continues with operation 440. Otherwise, the hearing device continues with operation 450.

In operation 440, the hearing device blocks a transmission path of the digital signal, and controls the wireless communication to be turned on. The transmission path may be, for example, the transmission path PATH1 or PATH2.

In operation 450, the hearing device compares the value of the measured acceleration of gravity with a second threshold. For example, the hearing device may determine whether the value of the measured acceleration of gravity is less than or equal to the second threshold. The second threshold may be, for example, a value of an acceleration of gravity pointing in the direction opposite to the center of the earth, and may have a negative value. When the value of the measured acceleration of gravity is less than or equal to the second threshold, the hearing device continues with operation 460. Otherwise, the hearing device continues with operation 470.

In operation 460, the hearing device controls the wireless communication to be turned on, and transmits the digital signal to another hearing device through the wireless communication.

In operation 470, the hearing device performs a typical operation, for example, an operation of a typical hearing aid.

The first threshold and the second threshold may be set by a DSP, for example, the DSP 140 or 240.

Figure 8:
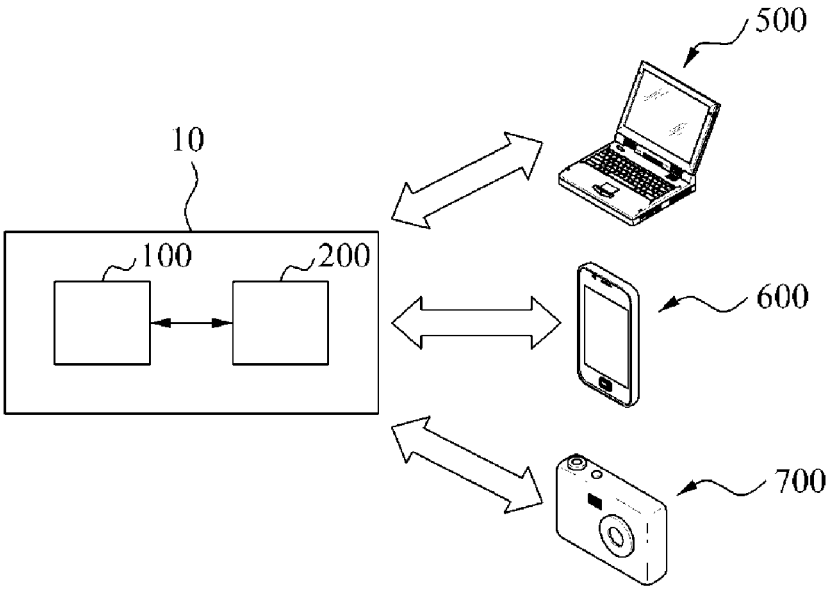
FIG. 8 is a diagram illustrating examples of electronic systems including the hearing apparatus of FIG. 1.

FIG. 8 illustrates examples of electronic systems 500, 600, and 700 including the hearing apparatus 10 of FIG. 1. Referring to FIG. 8, each of the electronic systems 500, 600 and 700 may be implemented as a personal computer (PC), a data server, and/or a portable electronic device. The portable electronic device may include, for example, a laptop computer, a mobile phone, a smart phone, a tablet PC, a personal digital assistant (PDA), an enterprise digital assistant (EDA), a digital still camera, a digital video camera, a portable multimedia player (PMP), a personal navigation device or a portable navigation device (PND), a handheld game console, and/or an e-book. The first hearing device 100 and the second hearing device 200 may wirelessly communicate with the electronic systems 500, 600 and 700.

The various units, modules, elements, and methods described above may be implemented using one or more hardware components, one or more software components, or a combination of one or more hardware components and one or more software components.

A hardware component may be, for example, a physical device that physically performs one or more operations, but is not limited thereto. Examples of hardware components include microphones, amplifiers, low-pass filters, high-pass filters, band-pass filters, analog-to-digital converters, digital-to-analog converters, and processing devices.

A software component may be implemented, for example, by a processing device controlled by software or instructions to perform one or more operations, but is not limited thereto. A computer, controller, or other control device may cause the processing device to run the software or execute the instructions. One software component may be implemented by one processing device, or two or more software components may be implemented by one processing device, or one software component may be implemented by two or more processing devices, or two or more software components may be implemented by two or more processing devices.

A processing device may be implemented using one or more general-purpose or special-purpose computers, such as, for example, a processor, a controller and an arithmetic logic unit, a digital signal processor, a microcomputer, a field-programmable array, a programmable logic unit, a microprocessor, or any other device capable of running software or executing instructions. The processing device may run an operating system (OS), and may run one or more software applications that operate under the OS. The processing device may access, store, manipulate, process, and create data when running the software or executing the instructions. For simplicity, the singular term "processing device" may be used in the description, but one of ordinary skill in the art will appreciate that a processing device may include multiple processing elements and multiple types of processing elements. For example, a processing device may include one or more processors, or one or more processors and one or more controllers. In addition, different processing configurations are possible, such as parallel processors or multi-core processors.

A processing device configured to implement a software component to perform an operation A may include a processor programmed to run software or execute instructions to control the processor to perform operation A. In addition, a processing device configured to implement a software component to perform an operation A, an operation B, and an operation C may have various configurations, such as, for example, a processor configured to implement a software component to perform operations A, B, and C; a first processor configured to implement a software component to perform operation A, and a second processor configured to implement a software component to perform operations B and C; a first processor configured to implement a software component to perform operations A and B, and a second processor configured to implement a software component to perform operation C; a first processor configured to implement a software component to perform operation A, a second processor configured to implement a software component to perform operation B, and a third processor configured to implement a software component to perform operation C; a first processor configured to implement a software component to perform operations A, B, and C, and a second processor configured to implement a software component to perform operations A, B, and C, or any other configuration of one or more processors each implementing one or more of operations A, B, and C. Although these examples refer to three operations A, B, C, the number of operations that may implemented is not limited to three, but may be any number of operations required to achieve a desired result or perform a desired task.

Software or instructions for controlling a processing device to implement a software component may include a computer program, a piece of code, an instruction, or some combination thereof, for independently or collectively instructing or configuring the processing device to perform one or more desired operations. The software or instructions may include machine code that may be directly executed by the processing device, such as machine code produced by a compiler, and/or higher-level code that may be executed by the processing device using an interpreter. The software or instructions and any associated data, data files, and data structures may be embodied permanently or temporarily in any type of machine, component, physical or virtual equipment, computer storage medium or device, or a propagated signal wave capable of providing instructions or data to or being interpreted by the processing device. The software or instructions and any associated data, data files, and data structures also may be distributed over network-coupled computer systems so that the software or instructions and any associated data, data files, and data structures are stored and executed in a distributed fashion.

For example, the software or instructions and any associated data, data files, and data structures may be recorded, stored, or fixed in one or more non-transitory computer-readable storage media. A non-transitory computer-readable storage medium may be any data storage device that is capable of storing the software or instructions and any associated data, data files, and data structures so that they can be read by a computer system or processing device. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, or any other non-transitory computer-readable storage medium known to one of ordinary skill in the art.

Functional programs, codes, and code segments for implementing the examples disclosed herein can be easily constructed by a programmer skilled in the art to which the examples pertain based on the drawings and their corresponding descriptions as provided herein.

As a non-exhaustive illustration only, a device described herein may refer to mobile devices such as, for example, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a personal digital assistant (PDA), a digital camera, a portable game console, an MP3 player, a portable/personal multimedia player (PMP), a handheld e-book, an ultra mobile personal computer (UMPC), a portable lab-top PC, a global positioning system (GPS) navigation, and devices such as a high definition television (HDTV), an optical disc player, a DVD player, a Blue-ray player, a setup box, or any other device capable of wireless communication or network communication consistent with that disclosed herein. In a non-exhaustive example, the wearable device may be self-mountable on the body of the user, such as, for example, the glasses or the bracelet. In another non-exhaustive example, the wearable device may be mounted on the body of the user through an attaching device, such as, for example, attaching a smart phone or a tablet to the arm of a user using an armband, or hanging the wearable device around the neck of a user using a lanyard.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A hearing apparatus, comprising:

a first hearing device attached to a left ear of a user; and a second hearing device attached to a right ear of the user, wherein the first hearing device is configured to block a transmission path through which a first digital signal is transmitted to the left ear, based on a posture of the user, the first digital signal being based on a first audio signal, and wherein the second hearing device is configured to wirelessly transmit a second digital signal to the first hearing device, based on the posture of the user, the second digital signal being based on a second audio signal.

2. The hearing apparatus of claim 1, wherein the first hearing device and the second hearing device are further configured to:

operate in a low-power operation mode based on a strength of the first digital signal and a strength of the second digital signal; and turn off a wireless communication in the low-power operation mode.

3. The hearing apparatus of claim 1, wherein the first hearing device and the second hearing device are further configured to:

sense a movement of the user; and detect the posture of the user based on the sensed movement.

4. The hearing apparatus of claim 3, wherein the first hearing device and the second hearing device are configured to:

periodically sense the movement of the user.

5. The hearing apparatus of claim 1, wherein the first hearing device comprises:

a microphone configured to sense a sound, and generate the first audio signal based on the sensed sound;

an analog-to-digital converter configured to convert the first audio signal to the first digital signal;

an acceleration sensor configured to sense a movement of the user, and generate a sensing signal based on the sensed movement; and a digital signal processor (DSP) configured to measure an acceleration of gravity of the first hearing device based on the sensing signal, detect the posture of the user based on the measured acceleration of gravity, and block the transmission path of the first digital signal based on the detected posture.

6. The hearing apparatus of claim 5, wherein the DSP is configured to:

block the transmission path of the first digital signal in response to the measured acceleration of gravity being greater than or equal to a set threshold.

7. The hearing apparatus of claim 1, wherein the second hearing device comprises:

a microphone configured to sense a sound, and generate the second audio signal based on the sensed sound;

an analog-to-digital converter configured to convert the second audio signal to the second digital signal;

an acceleration sensor configured to sense a movement of the user, and generate a sensing signal based on the sensed movement; and a digital signal processor (DSP) configured to measure an acceleration of gravity of the second hearing device based on the sensing signal, detect the posture of the user based on the measured acceleration of gravity, and transmit the second digital signal to the first hearing device based on the detected posture.

8. The hearing apparatus of claim 7, wherein the DSP is configured to:

transmit the second digital signal to the first hearing device in response to the measured acceleration of gravity being less than or equal to a set threshold.

9. A hearing device attached to an ear of a user, comprising:

a microphone configured to sense a sound, and generate an audio signal based on the sensed sound;

an analog-to-digital converter configured to convert the audio signal to a digital signal;

an acceleration sensor configured to sense a movement of the user wearing the hearing device, and generate a sensing signal based on the sensed movement; and a digital signal processor (DSP) configured to detect a posture of the user based on the sensing signal, block a transmission path through which the digital signal is transmitted to the ear based on the detected posture, and transmit the digital signal to another hearing device, based on the detected posture.

10. The hearing device of claim 9, wherein the DSP is further configured to: control the hearing device to operate in a low-power operation mode based on a strength of the digital signal; and wherein the operation in the low-power operation mode comprises turning off the transmission of the digital signal to the other hearing device.

11. The hearing device of claim 9, wherein:

the acceleration sensor is configured to periodically sense the movement of the user; and the DSP is configured to measure an acceleration of gravity based on the sensing signal, sample values of the measured acceleration of gravity for a predetermined period of time, and block the transmission path of the digital signal, or transmit the digital signal to the other hearing device, based on the sampled values of the measured acceleration of gravity.

12. The hearing device of claim 11, wherein the DSP is configured to:

block the transmission path of the digital signal in response to a value of the measured acceleration of gravity being greater than or equal to a set threshold.

13. The hearing device of claim 11, wherein the DSP is configured to:

transmit the digital signal to the other hearing device in response to a value of the measured acceleration of gravity being less than or equal to a set threshold.

14. The hearing device of claim 9, further comprising:

a communication unit configured to wirelessly transmit the digital signal to the other hearing device.

15. An operation method of a hearing device attached to an ear of a user, the operation method comprising:

sensing a movement of the user;

generating a sensing signal based on the sensed movement;

detecting a posture of the user based on the sensing signal;

blocking a transmission path through which a digital signal is transmitted to the ear, based on the detected posture the digital signal being based on an audio signal; and transmitting a digital signal to another hearing device, based on the detected posture.

16. The operation method of claim 15, further comprising:

operating in a low-power operation mode based on a strength of the digital signal; and wherein the operating in the low-power operation mode comprises turning off the transmitting of the digital signal to the other hearing device.

17. A non-transitory computer-readable storage medium storing a program comprising instructions to cause a computer to perform the operation method of claim 15.

18. A hearing device attached to an ear of a user, comprising:

a processor configured to detect a posture of the user based on a movement of the user;

block a transmission path through which a digital signal is transmitted to the ear, based on the detected posture, the digital signal being based on an audio signal; and transmit the digital signal to another hearing device, based on the detected posture.

19. The hearing device of claim 18, wherein the processor is configured to:

block the transmission path of the digital signal in response to the detected posture being a posture in which an ear of the user that wears the hearing device is directed towards the center of the earth; and transmit the digital signal to the other hearing device in response to the detected posture being a posture in which the ear of the user is directed opposite to the center of the earth.

* * * * *